US007578450B2

(12) United States Patent
Stockner et al.

(10) Patent No.: US 7,578,450 B2
(45) Date of Patent: Aug. 25, 2009

(54) FUEL INJECTOR WITH GROOVED CHECK MEMBER

(75) Inventors: Alan R Stockner, Metamora, IL (US); Thomas D Gens, Peoria, IL (US); Suryanarayan Banduvula, Peoria, IL (US); Kit D Minnich, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 487 days.

(21) Appl. No.: 11/211,977

(22) Filed: Aug. 25, 2005

(65) Prior Publication Data

US 2007/0057094 A1 Mar. 15, 2007

(51) Int. Cl.
*B05B 17/00* (2006.01)
*F02M 61/00* (2006.01)
*F02M 47/00* (2006.01)

(52) U.S. Cl. ..... 239/1; 239/5; 239/533.3; 239/533.12; 239/584

(58) Field of Classification Search ..... 239/533.12, 239/533, 1, 5, 584; 251/333, 356; 123/490
See application file for complete search history.

(56) References Cited

U.S. PATENT DOCUMENTS

| | | | | |
|---|---|---|---|---|
| 1,952,816 A | | 3/1934 | Mock | |
| 4,470,548 A | * | 9/1984 | Ushimura | 239/533.3 |
| 4,819,871 A | | 4/1989 | Kronberger et al. | |
| 4,925,110 A | * | 5/1990 | Takeda et al. | 239/533.12 |
| 5,199,398 A | * | 4/1993 | Nylund | 123/299 |
| 5,533,482 A | * | 7/1996 | Naitoh | 123/305 |
| 5,743,470 A | * | 4/1998 | Schlaf et al. | 239/533.4 |
| 5,787,708 A | | 8/1998 | Lane et al. | |
| 5,890,660 A | * | 4/1999 | Stevens | 239/533.3 |
| 6,109,540 A | | 8/2000 | Coldren et al. | |
| 6,257,506 B1 | * | 7/2001 | Hofmann et al. | 239/533.2 |
| 6,565,017 B1 | | 5/2003 | Fath et al. | |
| 6,647,966 B2 | | 11/2003 | Tian et al. | |
| 6,666,388 B2 | | 12/2003 | Ricco | |
| 6,669,117 B2 | * | 12/2003 | Boecking | 239/533.3 |
| 6,789,783 B2 | | 9/2004 | Boecking | |

(Continued)

FOREIGN PATENT DOCUMENTS

DE 103 06 808 A1 9/2004

(Continued)

OTHER PUBLICATIONS

SAE Technical Paper Series 910185, Contribution of Optimum Nozzle Design to Injection Rate Control, Nippondenso Co. Ltd., Feb. 25-Mar. 1, 1991.

*Primary Examiner*—Robin O Evans
*Assistant Examiner*—Daniel T Sharpe
(74) *Attorney, Agent, or Firm*—Finnegan, Henderson, Farabow, Garrett & Dunner

(57) ABSTRACT

A method and apparatus for injecting fluid into a machine are disclosed. A fluid injector is disclosed having a nozzle body with first and second body portions and at least one fluid injection orifice within the second body portion. The nozzle body may be configured for transmitting fluid from the first body portion toward the orifice. The fluid injector may also include a check member movably arranged inside the nozzle body for affecting fluid flow through the orifice and having a contoured outer surface defining (i) a recessed region and (ii) a generally convex region forming at least a portion of the recessed region.

26 Claims, 3 Drawing Sheets

U.S. PATENT DOCUMENTS

| | | | | |
|---|---|---|---|---|
| 6,826,833 | B1 * | 12/2004 | Maier et al. | 29/888.44 |
| 6,827,297 | B2 | 12/2004 | Hockenberger | |
| 6,892,965 | B2 * | 5/2005 | Haeberer et al. | 239/533.12 |
| 7,017,840 | B2 * | 3/2006 | Kruger et al. | 239/584 |
| 7,128,280 | B1 * | 10/2006 | Boecking | 239/533.12 |
| 7,188,790 | B2 * | 3/2007 | Astachow et al. | 239/585.1 |
| 7,309,029 | B2 * | 12/2007 | Boecking | 239/533.12 |
| 7,360,722 | B2 * | 4/2008 | Stockner et al. | 239/533.12 |
| 2002/0008166 | A1 * | 1/2002 | Fukaya et al. | 239/533.12 |
| 2002/0179743 | A1 | 12/2002 | Haeberer et al. | |
| 2003/0057299 | A1 | 3/2003 | Itoh | |
| 2004/0021014 | A1 * | 2/2004 | Pilgram et al. | 239/533.12 |
| 2004/0056118 | A1 | 3/2004 | Mattes et al. | |
| 2004/0195388 | A1 * | 10/2004 | Astachow et al. | 239/533.2 |
| 2005/0173565 | A1 * | 8/2005 | Cooke et al. | 239/533.12 |

FOREIGN PATENT DOCUMENTS

| | | | |
|---|---|---|---|
| EP | 1 555 430 | A | 7/2005 |
| GB | 1 560 614 | A | 2/1980 |
| GB | 2 186 632 | A | 8/1987 |
| GB | 2 308 408 | A | 6/1997 |
| JP | 2000320431 | | 11/2000 |
| WO | WO 03/098031 | A1 | 11/2003 |
| WO | WO 2004/085832 | A1 | 10/2004 |

* cited by examiner

FUEL INJECTOR WITH GROOVED CHECK MEMBER

TECHNICAL FIELD

This disclosure relates generally to a method and apparatus for controlling fluid flow and, more particularly, to a method and apparatus for controlling the injection of fluid.

BACKGROUND

Various fuel injection devices have been designed to transmit pressurized fuel through an injection nozzle into a combustion chamber of an engine. Typically, an injection nozzle will have one or more orifices formed in an end thereof, and a selectively movable check member will be arranged inside the nozzle to selectively permit or prevent pressurized fuel from exiting the nozzle through the injection orifices. The geometric configuration of a nozzle-check assembly may significantly impact various injection device characteristics, such as (i) injection device longevity, (ii) injection device cost, (iii) fuel injection repeatability, and (iv) engine exhaust emission levels, for example.

U.S. Patent Application Publication No. US 2003/0057299 A1 discloses a fuel injection nozzle having a nozzle body with at least one injection port therein, and having a nozzle needle that is displaceable within the nozzle body. The nozzle needle has a radial shoulder and, downstream of the shoulder, a circumferential groove that extends to the injection port. The radial shoulder is embodied with very sharp edges, presumably to reduce the effect of production variations. The recited object of the invention disclosed in the '299 publication is to provide reliable fuel metering.

Prior fuel injection devices may be improved by providing novel configurations and methods that effectively balance injection device longevity and cost, injection repeatability, and engine exhaust emissions effects.

The present invention is directed to overcome or improve one or more disadvantages associated with prior devices and methods for controlling the injection of fluid.

SUMMARY OF THE INVENTION

In one aspect of the present invention, a fluid injector is disclosed having a nozzle body with first and second body portions and at least one fluid injection orifice within the second body portion. The nozzle body may be configured for transmitting fluid from the first body portion toward the orifice.

The fluid injector may also include a check member movably arranged inside the nozzle body for affecting fluid flow through the orifice and having a contoured outer surface defining (i) a recessed region and (ii) a generally convex region forming at least a portion of the recessed region.

In another aspect of the present invention, a method of supplying fluid to a machine through a fluid injector is disclosed. The method may include transmitting fluid from a first portion of a nozzle body toward at least one fluid injection orifice defined in a second portion of the nozzle body. The method may further include moving a check member arranged within the nozzle body to transmit the fluid past (i) a recessed region about the outer surface of the check member and (ii) a generally convex outer surface of the check member forming at least a portion of the recessed region.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments or features of the invention and, together with the description, serve to explain the principles of the invention. In the drawings.

Although the drawings depict exemplary embodiments or features of the present invention, the drawings are not necessarily to scale, and certain features may be exaggerated in order to better illustrate and explain the present invention. The exemplifications set out herein illustrate exemplary embodiments or features of the invention and such exemplifications are not to be construed as limiting the scope of the invention in any manner.

DETAILED DESCRIPTION

Reference will now be made in detail to embodiments or features of the invention, examples of which are illustrated in the accompanying drawings. Wherever possible, the same or corresponding reference numbers will be used throughout the drawings to refer to the same or corresponding parts.

Figure 1:
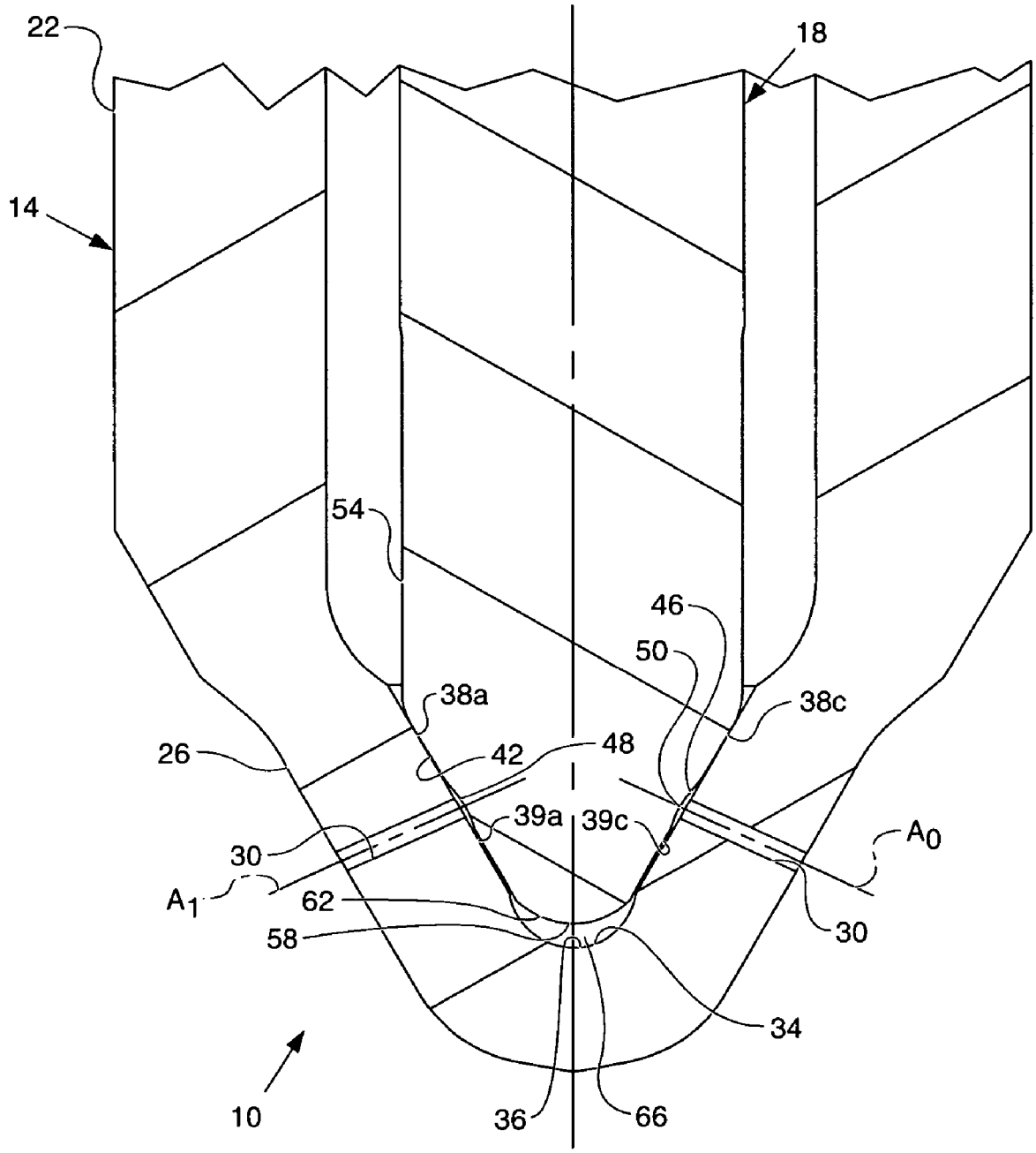
FIG. 1 is a sectional side elevational view of part of a fuel injector as described herein.

Referring now to FIG. 1, a fluid injector, such as a fuel injector 10, may include a nozzle body 14 and a check member 18 movably arranged inside the nozzle body 14. The nozzle body 14 may include a first body portion 22 and a second body portion or nozzle tip 26. The first body portion 22 may have a cylindrical internal configuration for housing the check member 18 and may be integrally formed with the nozzle tip 26. The nozzle tip 26 may have a generally conical internal configuration and may have one or more fluid injection orifices 30 formed therein. It should be appreciated that the nozzle body 14 may be configured for transmitting pressurized fluid (such as fuel from a fuel pump) through the first body portion 22 toward the orifices 30.

In one embodiment, the nozzle tip 26 has a generally curved internal wall 34 at an end portion 36 of the nozzle body 14. For example, the generally curved internal wall 34 shown in FIG. 1 has the form of a generally circular or arcuate wall surrounding an end portion of the check member 18.

The check member 18 may be movably arranged within the nozzle body 14. For example, the check member 18 may be biased via a spring (not shown) toward the internal wall 34 of the nozzle body 14 and held in a first position (as shown in FIG. 1) wherein the check member 18 contacts one or more check seat locations 38*a* on the tip 26 adjacent the orifices 30 at one or more valve seat locations 38*c* on the check member surface. With such an arrangement, the check member 18 may be configured to extend downstream past the orifices 30 in a valve covered orifice type configuration to at least partially cover the orifices 30. One skilled in the art would appreciate that the check member 18 may be selectively movable away from the check seats 38*a* to permit the transmission of fuel through the orifices 30.

Figure 2:
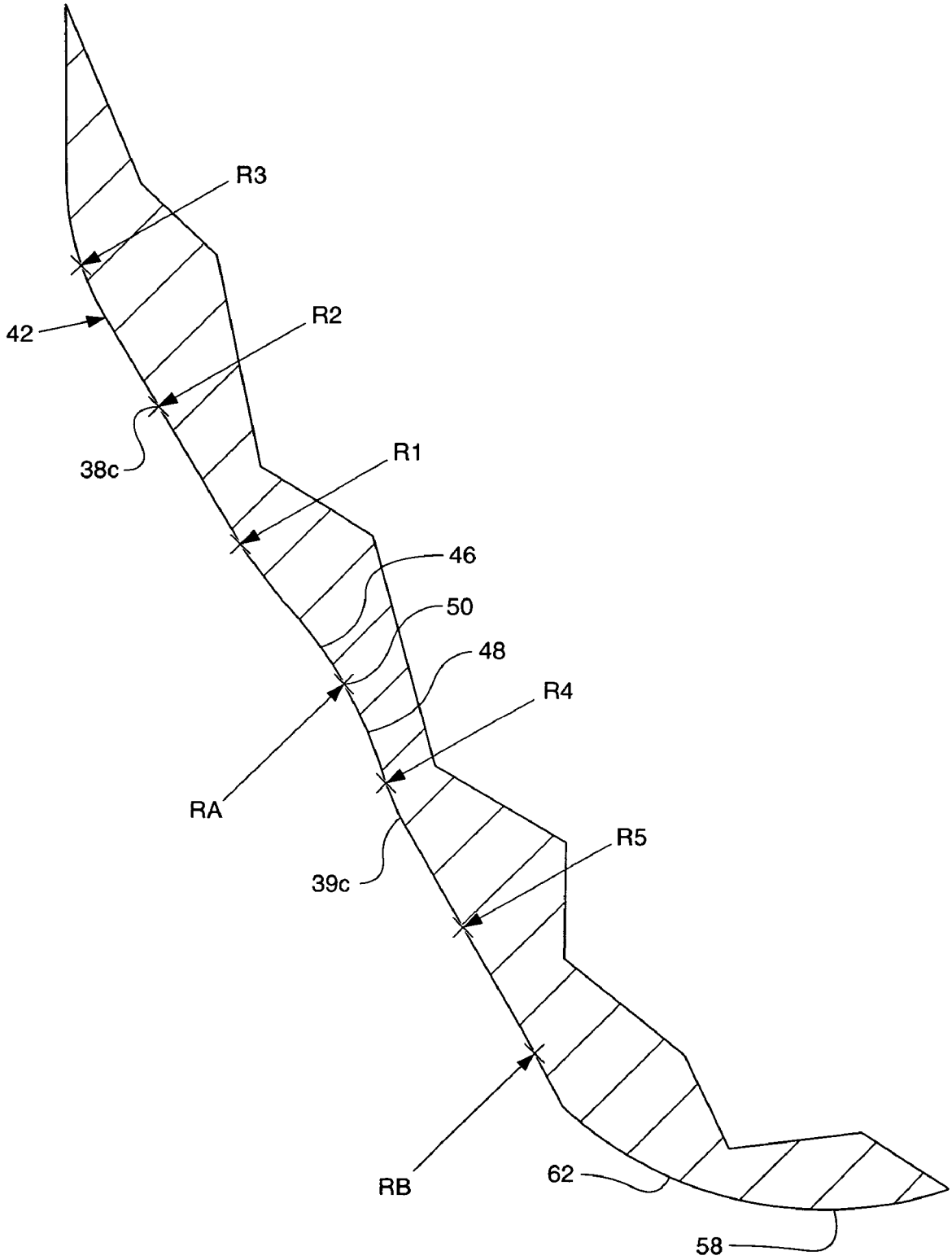
FIG. 2 is a view to an enlarged scale of part of the check member shown in FIG. 1.

With reference to FIGS. 1 and 2, the check member 18 may have a contoured outer surface 42 defining one or more generally convex regions R1, R2, R3, R4, R5 and one or more generally concave regions RA, RB. Moreover, the contoured outer surface 42 of the check member 18 may define a recessed region 46 having a predetermined fluid volume. In one embodiment, the recessed region 46 may have an upstream beginning at or proximate the valve seat location 38*c* and may have a downstream beginning at or proximate a region 39*c* disposed on the check member 18 at a location downstream of the orifices 30 (e.g., proximate region 39*a* of the nozzle body 14) when the check member 18 is in a flow blocking position. Thus, when the check member is in a flow blocking position (FIG. 1), the recessed region 46 may extend from a position upstream of the injection orifices 30 to a position downstream of the injection orifices 30.

The recessed region 46 may define a circumferential groove 48 about the check member 18. The recessed region 46 includes a bottom portion 50, which is the deepest part of the recessed region 46 (for example, the part of the recessed region 46 of FIG. 1 farthest from the plane of the conical internal wall of the tip 26).

In one embodiment, the recessed region 46 (such as in the form of the groove 48) may be configured with a volume equal to or less than about 0.2 $mm^3$. For example, in an exemplary embodiment, the recessed region 46 may be configured with a volume within a range of about 0.2 $mm^3$ to about 0.07 $mm^3$, such as a volume of about 0.15 $mm^3$ or a volume of about 0.075 $mm^3$.

The outer surface 42 of the check member 18 may define a generally convex region, the center of which is generally indicated at R1 of FIG. 1. The generally convex region R1 may be adjacent and interconnected with the recessed region 46 and may form a portion of the recessed region 46. The generally convex region R1 is arranged upstream (i.e., toward the source of pressurized fuel that feeds the tip 26—in FIG. 1, the first body portion 22 is upstream from the tip 26) of the bottom portion 50 of the recessed region 46.

The outer surface 42 of the check member 18 may further define another generally convex region R2 disposed upstream of the generally convex region R1 and having a different curvature than the generally convex region R1. For example, the generally convex region R2 may have a lesser degree of curvature than the generally convex region R1. In the embodiment of FIG. 1, the generally convex region R2 is arranged between a generally cylindrical outer surface 54 of the check member 18 and the generally convex region R1. In one embodiment, the generally convex region R2 forms an upstream beginning of the recessed region 46 and extends into the recessed region 46.

The outer surface 42 of the check member 18 may define yet another generally convex region R3 disposed upstream of the generally convex region R2, between the generally cylindrical outer surface 54 of the check member 18 and the generally convex region R2. The generally convex region R3 has a different curvature than the generally convex region R2. For example, the generally convex region R3 may have a greater degree of curvature than the generally convex region R2.

The outer surface 42 of the check member 18 may define another generally convex region R4 disposed downstream of the bottom portion 50 of the recessed region 46, between the bottom portion 50 of the recessed region 46 and an end portion 58 of the check member 18. The generally convex region R4 may be interconnected with and adjacent the recessed region 46. In one embodiment, the generally convex region R4 forms a downstream beginning of the recessed region 46 and extends into the recessed region 46.

The outer surface 42 of the check member 18 may define yet another generally convex region R5 disposed downstream of the generally convex region R4, between the generally convex region R4 and the end portion 58 of the check member 18. The generally convex region R5 has a different curvature than the generally convex region R4. For example, the generally convex region R5 may have a lesser degree of curvature than the generally convex region R4.

The outer surface 42 of the check member 18 may also define a generally concave region RA disposed downstream of the generally convex region R1, for example between the generally convex regions R1 and R4. The generally concave region RA may be adjacent and interconnected with the generally convex region R1 and may define a portion of the recessed region 46. In the embodiment of FIG. 2, the generally concave region RA forms the bottom portion 50 of the recessed region 46.

The outer surface 42 of the check member 18 may define another generally concave region RB disposed downstream of the generally concave region RA, between the generally concave region RA and the end portion 58 of the check member 18. More specifically, the generally concave region RB may be disposed downstream of the generally convex region R5 between the generally convex region R5 and the end portion 58 of the check member 18.

The check member 18 may also include a generally curved region 62 at the end portion 58 of the check member 18. Moreover, the generally curved region 62 may have a contour that substantially matches the contour of the generally curved internal wall 34 of the tip 26. For example, the embodiment of FIG. 1 includes a generally convex curved region 62 having substantially the same or about the same curvature as the generally curved internal wall 34 of the tip 26. The substantially matching contours of the generally curved region 62 of the check member 18 and the generally curved internal wall 34 of the tip 26 facilitate a reduced volume chamber 66 (described hereinbelow) formed therebetween helping maintain or reduce certain engine combustion emissions characteristics.

INDUSTRIAL APPLICABILITY

This disclosure provides an apparatus and method for controlling the injection of fuel into an engine. The apparatus described herein is predicted to facilitate repeatable, reliable injection performance with enhanced longevity while balancing engine emissions and cost effects. It should be appreciated that the components and arrangements described herein may be applied by one skilled in the art to various injector designs, including but not limited to an electronically controlled unit injector, a hydraulically-actuated electronically controlled unit injector, a mechanically-actuated injector, or an injector coupled with a pump and line fuel system, for example.

Figure 3:
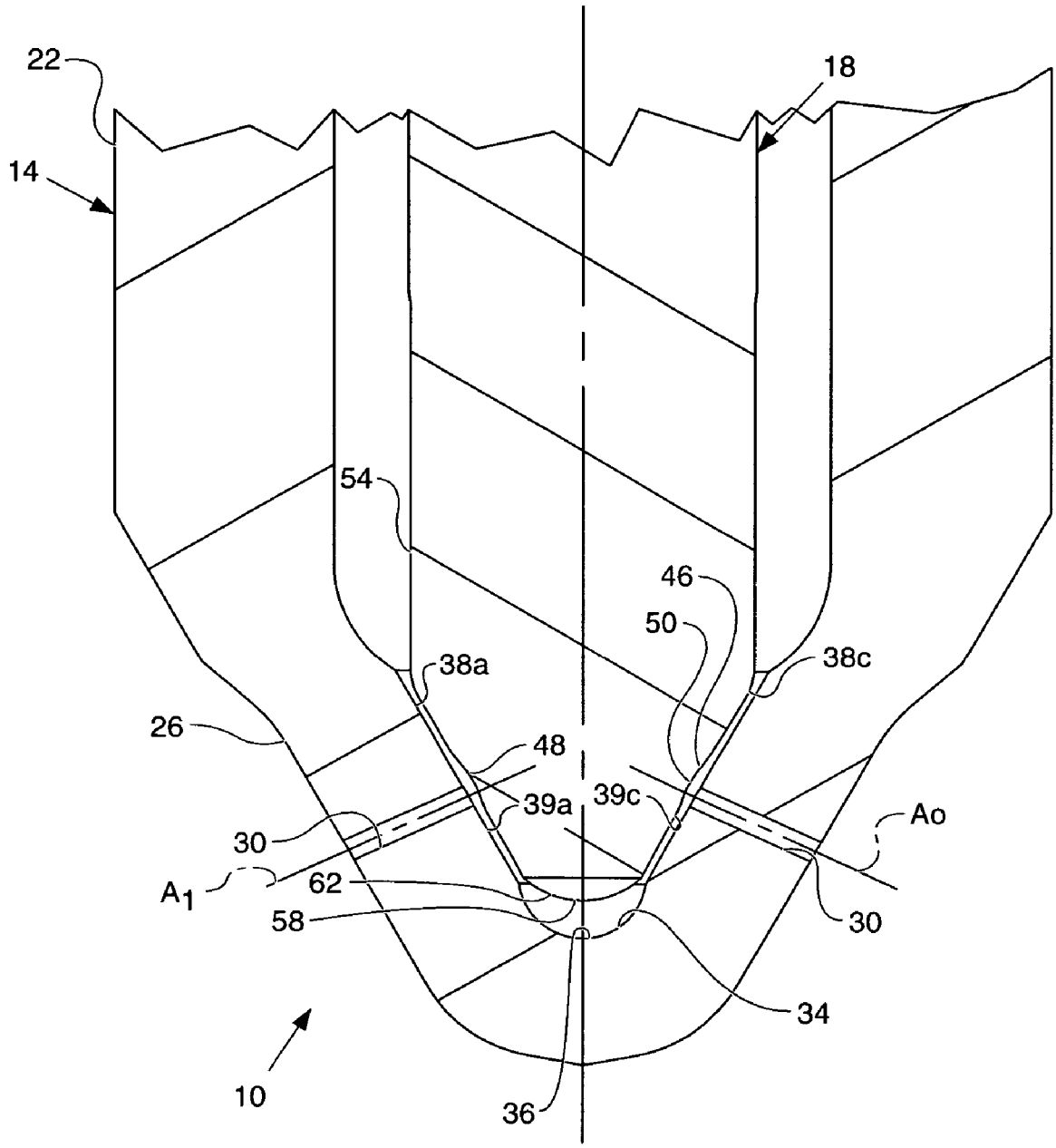
FIG. 3 is a sectional side elevational view of the fuel injector shown in FIG. 1, wherein the check member is in a flow passing position.

One skilled in the art would appreciate that the check member 18 may be moved to a flow blocking position (FIG. 1) and a flow passing position (FIG. 3).

In a flow blocking position (FIG. 1), the upstream valve seat locations 38*c* of the check member 18 may be seated on the check seat locations 38*a* of the tip 26 so that fluid is prevented from flowing from within the nozzle body 14 into the injection orifices 30 from upstream of the orifices 30. Moreover, the valve covered orifice configuration of the embodiment shown in FIG. 1 may at least inhibit fluid flow through the orifices 30 from downstream of the orifices 30. In the embodiment of FIG. 1, in a flow blocking position the recessed region 46, which forms groove 48, is disposed proximate the injection orifices 30 and is arranged in fluid communication with the injection orifices 30. More specifically, the bottom portion 50 of the recessed region 46 is disposed proximate the injection orifices 30 and is generally centered on a longitudinal axis $A_O$ of at least one of the orifices 30. As in the embodiment of FIG. 1, the bottom portion 50 of the recessed region 46 may be generally centered on the longitudinal axes $A_0$, $A_1$ of all of the orifices 30. It should be appreciated that when the check member 18 of FIG. 1 is arranged in the flow blocking position, the recessed region 46 may be at least partially arranged between the check seat location 38*a*, which is upstream of the orifices 30, and the region 39*a* of the nozzle body 14, which is downstream of the orifices 30.

In the flow blocking position, a chamber volume 66, or sac volume, exists between the end portion 58 of the check member 18 and the end portion 36 of the nozzle body 14. The generally curved region 62 of the check member 18 may be arranged within the chamber volume 66 such that the chamber volume 66 is bounded, at least in part, by the generally curved region 62 of the check member 18 and the generally curved wall 34 of the nozzle body 14.

In one embodiment, the chamber volume 66 may be configured with a volume equal to or less than about 0.7 $mm^3$ when the check member 18 is in a flow blocking position. For example, in an exemplary embodiment, the chamber volume 66 may be configured with a volume within a range of about 0.7 $mm^3$ to about 0.3 $mm^3$, such as a volume of about 0.67 $mm^3$ or a volume of about 0.35 $mm^3$.

When the check member 18 is moved to a flow passing position (FIG. 3), the valve seat locations 38*c* are lifted off of the check seat locations 38*a* to allow fluid to be transmitted from the first body portion 22 toward the tip 26, past the generally cylindrical outer surface 54 of the check member, past the generally convex regions R3, R2, and R1 and the check seat locations 38*a* and into the fluid injection orifices 30 for transmission into a machine, such as into the combustion chamber of an engine for example. It should be appreciated that some of the fluid may be transmitted past the orifices 30 and the generally convex regions R4 and R5 to enter the chamber volume 66 region.

In a flow passing position, the generally convex regions R1, R2 may be disposed adjacent the injection orifices 30. Moreover, at least a portion of the generally convex regions R1, R2 may be arranged at least slightly upstream of the injection orifices 30 so that the fluid communicates with the generally convex regions R1, R2 prior to entering the orifices 30. Moreover, the bottom portion 50 of the recessed region 46 may also be arranged at least partially upstream of the injection orifices 30 so that the fluid communicates with the bottom portion 50 prior to entering the orifices 30. Thus, as fluid flows downstream from the first body portion 22 of the nozzle body 14 toward the injection orifices 30 past the generally convex region R3, the fluid may approach and flow through a gradually widening channel defined by the wall of the nozzle body 14 and the recessed region 46 of the check member 18 so that the velocity of the fluid is reduced prior to the fluid entering the orifices 30. More specifically, the velocity of the fluid may be reduced as it flows past and fluidly communicates with the generally convex regions R1, R2 of the check member 18 and the recessed region 46 of the check member 18 prior to entering the orifices 30. With a configuration as disclosed herein, pressurized fluid transmitted through the injector is estimated to experience a decrease in fluid separation phenomena proximate or within the orifices 30, thereby decreasing fluid cavitation effects within the tip 26 to ultimately decrease potential damage to the injector and increase the life of the injector. Moreover, increased injection spray uniformity, for example via improved check lift characteristics, is also estimated to result.

The geometrical and structural elements (e.g., one or more of the generally convex regions) described herein are further estimated to facilitate one or more desirable characteristics for fuel injectors, such as providing smooth velocity transition regions and/or uniform pressure distributions within the fuel injector when the injector is in a flow passing state, beneficial management of stresses and pressures generated within the check member 18 during operation of the check member (e.g., resulting from repeated engagement with the nozzle body 14), and improved manufacturability.

From the foregoing it will be appreciated that, although specific embodiments of the invention have been described herein for purposes of illustration, various modifications may be made without deviating from the spirit or scope of the invention. Other embodiments of the invention will be apparent to those skilled in the art from consideration of the specification and figures and practice of the invention disclosed herein. It is intended that the specification and disclosed examples be considered as exemplary only, with a true scope and spirit of the invention being indicated by the following claims and their equivalents. Accordingly, the invention is not limited except as by the appended claims.

What is claimed is:

1. A fluid injector, comprising:

a nozzle body having first and second body portions and at least one fluid injection orifice within the second body portion, the nozzle body being configured for transmitting fluid from the first body portion toward the orifice;

a check member movably arranged inside the nozzle body for affecting fluid flow through the orifice and having a contoured outer surface defining (i) a recessed region, (ii) a generally convex region forming at least a portion of the recessed region, and (iii) a first generally concave region between the recessed region and an end of the check member, wherein the recessed region has a bottom portion that is generally centered on the longitudinal axis of the at least one fluid injection orifice when the check member is in a flow blocking position, and wherein the generally convex region is a continuous outward curve having a predetermined curvature, and the first generally concave region is a continuous inward curve having a second predetermined curvature.

2. The injector of claim 1, wherein the generally convex region forms an upstream beginning of the recessed region.

3. The injector of claim 1, wherein the generally convex region forms a downstream beginning of the recessed region.

4. The injector of claim 1, wherein the recessed region defines a circumferential groove about the check member.

5. The injector of claim 1, wherein the recessed region has a bottom portion arranged between the generally convex region and the end of the check member.

6. The injector of claim 1, wherein the contoured outer surface of the check member defines a second generally concave region forming at least a portion of the recessed region.

7. The injector of claim 6, wherein the second generally concave region defines the bottom portion of the recessed region.

8. The injector of claim 1, wherein the check member is movable to a flow passing position in which the at least a portion of the generally convex region is disposed upstream of the injection orifice.

9. The injector of claim 1, wherein the check member is movable to a flow passing position in which a bottom portion of the recessed region is disposed at least partially upstream of the injection orifice.

10. The injector of claim 1, wherein the check member is movable to the flow blocking position in which (i) the check member engages the nozzle body to prevent fluid flow through the injection orifice and (ii) the bottom portion of the recessed region is disposed adjacent the injection orifice.

11. The injector of claim 1, wherein:

the check member includes a generally cylindrical outer surface;

the generally convex region is a first generally convex region; and the contoured outer surface of the check member defines a second generally convex region that (i) is disposed between the generally cylindrical outer surface and the first generally convex region and (ii) has a different curvature than the first generally convex region.

12. The injector of claim 11, wherein the second generally convex region forms an upstream beginning of the recessed region.

13. The injector of claim 11, wherein the contoured outer surface of the check member defines a third generally convex region that is (i) disposed between the generally cylindrical outer surface and the second generally convex region and (ii) has a different curvature than the second generally convex region.

14. The Injector of claim 1, wherein:

the generally convex region is a first generally convex region:

the bottom portion of the recessed region Is arranged between the first generally convex region and the end of the check member; and the contoured outer surface of the check member defines a second generally convex region that (i) is disposed between the bottom portion of the recessed region and the end of the check member and (ii) forms at least a portion of the recessed region.

15. The injector of claim 14, wherein the second generally convex region forms a downstream beginning of the recessed region.

16. The Injector of claim 14, wherein:

the contoured outer surface of the check member defines a third generally convex region that (i) Is disposed between the second generally convex region and the end of the check member and (ii) has a different curvature than the second generally convex region.

17. The injector of claim 14, wherein:

the first generally concave region is disposed between the second generally convex region and the end of the check member.

18. The fluid injector of claim 1, wherein the nozzle body has a plurality of fluid injection orifices therein, and the bottom portion is generally centered on the longitudinal axes of all of the plurality of fluid injection orifices when the check member is in a flow blocking position.

19. A method of supplying fluid to a machine through a fluid injector, the method comprising:

transmitting fluid from a first portion of a nozzle body toward at least one fluid injection orifice defined in a second portion of the nozzle body;

moving a check member arranged within the nozzle body to transmit the fluid past (i) a recessed region about the outer surface of the check member and (ii) a generally convex outer surface of the check member forming at least a portion of the recessed region. wherein the convex outer surface is a continuous outward curve having a predetermined curvature; and blocking fluid flow to the at least one fluid injection orifice from downstream of the at least one fluid injection orifice when the check member is in a flow blocking position.

20. The method of claim 19, wherein the step of moving a check member arranged within the nozzle body to transmit the fluid includes reducing the velocity of the fluid.

21. The method of claim 19, wherein the step of moving a check member arranged within the nozzle body to transmit the fluid includes causing the fluid to communicate with a circumferential groove formed about the check member and defined at least in part by the recessed region.

22. The method of claim 19, wherein the step of moving a check member arranged within the nozzle body to transmit the fluid includes transmitting the fluid past the generally convex outer surface of the check member and toward a generally concave outer surface of the check member.

23. The method of claim 19, including transmitting the fluid so that the fluid enters the injection orifice after it flows past at least part of the generally convex outer surface of the check member.

24. The method of claim 23, including transmitting the fluid so that the fluid enters the injection orifice after it flows past a bottom portion of the recessed region.

25. The method of claim 19, including transmitting the fluid so that, upstream of the generally convex outer surface, the fluid (i) communicates with a generally cylindrical outer surface of the check member and (ii) then communicates with a second generally convex outer surface of the check member having a different curvature than the generally convex outer surface.

26. The method of claim 19, including transmitting the fluid so that, after the fluid flows past a bottom portion of the recessed region, the fluid flows past a second generally convex outer surface of the check member forming at least a portion of the recessed region.

* * * * *